United States Patent [19]

Di Troia et al.

[11] Patent Number: 5,043,689

[45] Date of Patent: Aug. 27, 1991

[54] TIME DELAY FUSE

[75] Inventors: Gary W. Di Troia, Saugus, Mass.; Paul M. Romani, Pawtucket, R.I.

[73] Assignee: Gould Inc., Eastlake, Ohio

[21] Appl. No.: 592,135

[22] Filed: Oct. 3, 1990

[51] Int. Cl.[5] ..... H01H 85/04

[52] U.S. Cl. ..... 337/165; 337/163

[58] Field of Search ..... 337/163, 164, 165, 166, 337/162, 161

[56] References Cited

U.S. PATENT DOCUMENTS

| | | | |
|---|---|---|---|
| 2,293,953 | 8/1942 | Taylor . | |
| 2,321,711 | 6/1943 | Taylor . | |
| 2,342,310 | 2/1944 | Taylor . | |
| 2,386,094 | 10/1945 | Duerkob . | |
| 2,613,297 | 10/1952 | Laing . | |
| 2,688,677 | 9/1954 | Laing . | |
| 2,694,124 | 11/1954 | Laing . | |
| 2,913,555 | 11/1959 | McAlister . | |
| 3,144,534 | 8/1964 | Baumbach . | |
| 3,863,188 | 1/1975 | Knapp, Jr. . | |
| 4,048,610 | 9/1977 | Jacobs, Jr. | 337/165 |
| 4,321,574 | 3/1982 | Pertici . | |
| 4,517,544 | 5/1985 | Spaunhorst . | |
| 4,533,895 | 10/1985 | Kowalik et al. . | |
| 4,562,420 | 12/1985 | Kowalik et al. . | |
| 4,727,347 | 2/1988 | Cambio | 337/165 |

*Primary Examiner*—Harold Broome

*Attorney, Agent, or Firm*—Fish & Richardson

[57] ABSTRACT

A time delay fuse including a fuse casing, a preassembly including a wall member, a pin passing through a hole through the wall member, solder on one side of the wall member restraining the pin from movement through the hole and electrically connecting a fusible element thereto, a spring engaging the pin and on the other side of the wall member and biasing the spring in a direction away from the solder, and a wire that is electrically connected to the pin, a terminal at an end of the casing making electrical connection to the fusible element, and a terminal at the other end of the casing making electrical connection to the wire.

13 Claims, 1 Drawing Sheet

TIME DELAY FUSE

BACKGROUND OF THE INVENTION

The invention relates to time delay fuses.

Time delay fuses usually have a fusible element (e.g., a wire) that quickly melts at short circuit conditions (e.g., 30 times the rated current) and another means to break the circuit slowly (e.g., solder that retains a spring-loaded member and melts after the solder and an adjacent heat mass have been raised to a specific temperature, the heat mass providing the delay) at lower overloads (e.g., 2 to 4 times rated current) to permit use with equipment having temporary surges such as motors. Time delay fuses are described in U.S. Pat. Nos. 4,533,895; 3,863,188; 2,321,711; 2,694,124; 4,048,610; 3,144,534; 4,562,420; 2,688,677; 2,613,297; 4,727,347; 2,293,953; 4,321,574; 4,517,544; 2,342,310; 2,386,094; and 2,913,555.

SUMMARY OF THE INVENTION

Our invention features, in general, a time delay fuse that includes a preassembly that is mounted within a fuse casing and is electrically connected between end terminals on the fuse casing. The preassembly includes a wall member and a pin mounted for sliding movement through a hole through the wall member. The pin is biased by a spring on one side of the wall member for movement in the direction of the spring and is restrained from passing through the hole by solder on the other side of the wall member. A wire of the preassembly electrically connects the pin on the spring side of the wall member to one end terminal. A fusible element is connected at one end to the solder that also restrains the pin from movement and at the other end to the other end terminal. The preassembly facilitates manufacture by employing a single critical solder mass and providing direct electrical connection of the preassembly to end terminals.

In preferred embodiments, the wall member extends across the fuse casing, and there is a means to position the wall member in the fuse casing. The wall member and means to locate are part of a cup-shaped spacer member that has a cavity in which the spring and pin are located and an open end through which the wire passes to the end terminal. The spring is disposed around the pin and spaced from it where the pin emerges from the hole to avoid contact with solder that might be carried through the hole. The wire is made of multiple strands to provide flexibility and little resistance to travel of the pin. A metal washer is located between the wall member and the solder to provide additional heat mass and facilitate attachment of the solder. There is an arc quenching fill material within the casing around the fusible element, and the wall member keeps the fill by the fusible element and away from the cavity. There is a head on the pin that is engaged by the spring. The end terminals are end cap terminals that are pressed onto the fuse casing.

Other advantages and features of the invention will be apparent from the following description of a preferred embodiment thereof and from the claims.

DESCRIPTION OF THE PREFERRED EMBODIMENT

The preferred embodiment will now be described.

DRAWING

STRUCTURE, MANUFACTURE AND OPERATION

Figure 1:
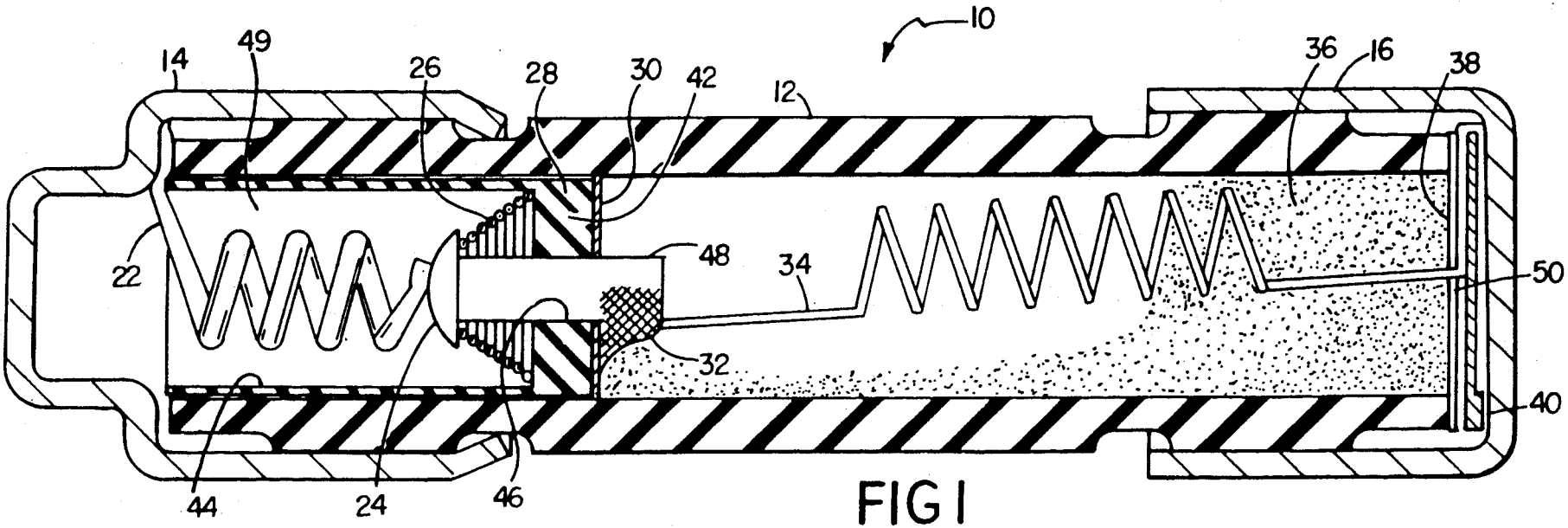
FIG. 1 is vertical sectional view of a time delay fuse according to the invention.
Figure 2:
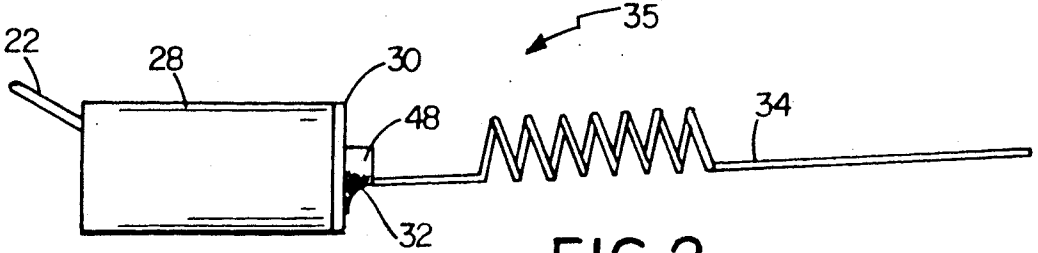
FIG. 2 is a plan view of a preassembly of the FIG. 1 fuse.

Referring to FIG. 1, there is shown time delay fuse 10, which includes tubular fuse casing 12 (made of NEMA grade material a glass fabric base convolute wound tube with melamine resin binder) and end cap terminals 14 and 16. Within tube 12 are braided copper wire 22 (0.015"×0.025"), pin 24 (made of cartridge brass), spring 26 (made of coiled music wire), spacer member 28 (made of L-3 steatite ceramic), washer 30 (made of cartridge brass), solder mass 32 (0.14 gram of a eutectic solder having 16% tin, 32% lead, and 52% bismuth), short circuit fusible element 34 (having 0.0070" brass and 0.0030" copper strands and coiled to have an 0.093" inner diameter and seven coils), arc quenching fill material 36 (50/70 quartz), slotted brass plate 38 and fiber washer 40 (made of vulcanized fiber).

Spring 26 biases pin 24 to the left. Solder 32 retains pin 24 from movement and electrically connects fusible element 34 to pin 24. Pin 24, washer 30 and solder mass 32 provide a heat mass that slowly rises in temperature at low overload conditions. Spacer 28 is cup-shaped and includes circular wall member 42 and cylindrical extension 44. The inner diameter of fuse casing 12 is 0.234"±0.002", and the outer diameter of cylindrical extension 44 is 0.220"±0.001". Wall member 42 has hole 46 through it providing a passage in which shaft 48 of pin 24 can slide. Hole 46 is 0.068"+0.005"−0.000" in diameter, and shaft 48 is 0.062"±0.002" in diameter. Cylindrical extension 44 positions wall member 42 at the desired location within casing 12, and provides cavity 49 in which pin 24 moves by spring action when released. Spacer member 28 prevents arc quenching fill 36 from getting into cavity 49. Fusible element 34 passes through slot 50 in plate 38 and wraps around one end of fiber washer 40.

In manufacture, preassembly 35 is first made of elements 22–34. Electrical wire 22 is connected to the enlarged head of pin 24 by welding before forming its coils. Shaft 48 of pin 24 is inserted through spring 26, hole 46 and washer 30 until spring 26 is compressed and the desired amount of shaft 48 extends beyond washer 30. A U-shaped preform of the proper amount of solder 32 is placed and melted on the surface of brass washer 30 and shaft 48 with an end of fusible element 34 in the solder mass.

In assembling fuse 10, spacer member 28 is first placed in position in casing 12; the free end of wire 22 is placed around the end of casing 12 with a solder preform, and end cap terminal 14 is pressed into position on casing 12, sealing off the end of fuse casing 12 and making electrical connection to wire 22. Arc quenching fill material 36 is then poured into the other side of casing 12, and the free end of fusible element 34 is placed within slot 50 of plate 38 as plate 38 is moved into position to close the end of casing 12. The free end of fusible element 34 is placed around an end of fiber washer 40. A solder preform is added prior to pressing end cap terminal 16 into position on casing 12, sealing off the end of fuse casing 12 and making electrical connection to fusible element 34. The solder preforms at the end cap terminals are then melted by inductive heating.

In operation, fusible element 34 melts quickly at short circuit conditions. The combined heat mass provided by pin 24, washer 30 and solder 32 slowly rises in temperature at low overloads. When solder 32 reaches its melting temperature, pin 24 is released and biased to the left by spring 26, breaking the circuit. The multiple strands of wire 22 give it flexibility, which avoids inhibiting travel of pin 24. The base of spring 26 against wall member 42 is spaced from hole 46 so that it does not contact any solder that might be carried through hole 46 with shaft 48.

Other embodiments of the invention are within the scope of the following claims.

What is claimed is:

1. A time delay fuse comprising (a) a fuse casing having a chamber therein, (b) a preassembly in said chamber comprising (i) a wall member, (ii) a pin passing through a hole through said wall members, (iii) a solder mass on one side of said wall member restraining said pin from movement through said hole, (iv) a fusible element that has an end anchored in said solder mass, (v) a spring engaging said pin on the other side of said wall member from said solder mass and biasing said pin in a direction away from said solder mass, and (vi) a wire that is electrically connected to said pin, (c) a first terminal at one end of said casing making electrical connection to said fusible element, and (d) a second terminal at the other end of said casing making electrical connection to said wire.

2. The time delay fuse of claim 1 wherein said wall member is sized to extend across said chamber, and further comprising means to position said wall member at a desired location within said casing.

3. The time delay fuse of claim 2 wherein said wall member is circular, and said means to position is cylindrical and is integrally formed with said wall member to form a cup-shaped spacer member, said spacer member defining a cavity in which said spring and pin are located, said spacer having an open end through which said wire passes to said second terminal.

4. The time delay fuse of claim 1 wherein said wall member is made of electrically non-conductive material.

5. The time delay fuse of claim 1 wherein said spring is disposed around said pin and spaced from it where said pin emerges from said hole.

6. The time delay fuse of claim 1 wherein said wire is made of multiple strands to provide flexibility and little resistance to travel of said pin.

7. The time delay fuse of claim 4 wherein said preassembly further comprises a metal washer that is positioned between said wall member and said solder.

8. The time delay fuse of claim 1 wherein arc quenching fill material surrounds said fusible element.

9. The time delay fuse of claim 3 wherein said pin has an enlarged head on it.

10. The time delay fuse of claim 1 wherein said first and second terminals are end cap terminals that are snapped into position on said fuse casing.

11. A method of making a time delay fuse comprising (a) providing a preassembly comprising (i) a wall member, (ii) a pin passing through a hole through said wall member, (iii) a solder mass on one side of said wall member restraining said pin from movement through said hole, (iv) a fusible element that has an end anchored in said solder mass, (v) a spring engaging said pin on the other side of said wall member from said solder mass and biasing said pin in a direction away from said solder mass, and (vi) a wire that is electrically connected to said pin, (b) placing said preassembly in a fuse casing having a chamber therein, (c) attaching a first terminal to one end of said casing and making electrical connection between said first terminal and said fusible element, and (d) attaching a second terminal to the other end of said casing and making electrical connection between said second terminal and said wire.

12. The method of claim 11 wherein said wall member is sized to extend across said chamber, and said preassembly also includes means to position said wall member at a desired location within said casing, and further comprising filling said casing with arc quenching fill material on said one side of said wall member.

13. The method of claim 12 wherein said wall member is circular, and said means to position is cylindrical and is integrally formed with said wall member to form a cup-shaped spacer member, said spacer member defining a cavity in which said spring and pin are located, said spacer having an open end through which said wire passes to said second terminal.

* * * * *